US008903286B2

(12) United States Patent
You et al.

(10) Patent No.: US 8,903,286 B2
(45) Date of Patent: Dec. 2, 2014

(54) IMAGE FORMING APPARATUS AND CONTROL METHOD THEREOF TO CONTROL A CLEANING MEMBER AND TO TRANSFER IMAGES ACCORDING TO POSITION MARKS ON A TRANSFER MEMBER

(75) Inventors: Ho Gun You, Hwaseong-si (KR); Tae Il Jung, Suwon-si (KR); Chang Hyun Oh, Gwangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 343 days.

(21) Appl. No.: 12/905,206

(22) Filed: Oct. 15, 2010

(65) Prior Publication Data

US 2011/0097105 A1 Apr. 28, 2011

(30) Foreign Application Priority Data

Oct. 23, 2009 (KR) ..... 2009-101266

(51) Int. Cl.
*G03G 15/01* (2006.01)
*G03G 15/16* (2006.01)

(52) U.S. Cl.
CPC ..... *G03G 15/161* (2013.01); *G03G 2215/0158* (2013.01); *G03G 15/0131* (2013.01)
USPC ..... 399/301; 399/101

(58) Field of Classification Search
USPC ..... 399/71, 101, 343, 345, 301
See application file for complete search history.

(56) References Cited

U.S. PATENT DOCUMENTS

| | | | | |
|---|---|---|---|---|
| 4,577,953 | A | * | 3/1986 | Narukawa |
| 4,647,177 | A | * | 3/1987 | Yoshihito et al. |
| 4,696,562 | A | * | 9/1987 | Urata et al. |
| 5,270,769 | A | * | 12/1993 | Satoh et al. |
| 5,828,926 | A | * | 10/1998 | Iwata et al. |
| 6,160,569 | A | * | 12/2000 | Fujimori et al. |
| 2007/0147863 | A1 | | 6/2007 | Takahashi |
| 2007/0166082 | A1 | * | 7/2007 | Byun |

FOREIGN PATENT DOCUMENTS

| | | | | |
|---|---|---|---|---|
| CN | 1232975 | | | 10/1999 |
| CN | 101000481 | | | 7/2007 |
| JP | 04345457 | | | 12/1992 |
| JP | 04345457 | A | * | 12/1992 |
| JP | 0934329 | | | 2/1997 |
| JP | 09034329 | A | * | 2/1997 |

* cited by examiner

*Primary Examiner* — Walter L Lindsay, Jr.
*Assistant Examiner* — Milton Gonzalez
(74) *Attorney, Agent, or Firm* — Staas & Halsey LLP

(57) ABSTRACT

Disclosed herein are an image forming apparatus and a control method thereof. In the image forming apparatus, an intermediate transfer member is provided with a position identification mark, to enable sensing of a position of the intermediate transfer member after a cleaning unit is completely spaced apart from the intermediate transfer member. An image formation/transfer position can be controlled in response to a sensing signal of the position identification mark, so that respective colors of developer images may be formed and transferred to the same position on the intermediate transfer member in a state in which contact between the cleaning unit and the intermediate transfer member is released. This minimizes and/or prevents color discrepancy between the respective colors of developer images.

27 Claims, 7 Drawing Sheets

IMAGE FORMING APPARATUS AND CONTROL METHOD THEREOF TO CONTROL A CLEANING MEMBER AND TO TRANSFER IMAGES ACCORDING TO POSITION MARKS ON A TRANSFER MEMBER

CROSS-REFERENCE TO RELATED APPLICATIONS

This application claims priority under 35 U.S.C. §119(a) from Korean Patent Application No. 2009-0101266, filed on Oct. 23, 2009 in the Korean Intellectual Property Office, the disclosure of which is incorporated herein by reference in its entirety.

BACKGROUND

1. Field of the Invention

The present general inventive concept relates to an image forming apparatus and a control method thereof, and, more particularly, to an image forming apparatus in which respective colors of developer images may be transferred to the same position on an intermediate transfer belt, and a control method thereof.

2. Description of the Related Art

Generally, color image forming apparatuses may be classified into a multi-pass type color image forming apparatus in which a color image is formed using a single photoconductor, and a single-pass type color image forming apparatus in which a color image is formed using a plurality of photoconductors.

The multi-pass type color image forming apparatus includes an intermediate transfer belt. After different colors of developer images formed on the plurality of photoconductors are transferred to and overlap one another on the intermediate transfer belt thus forming a primary transfer image, the intermediate transfer belt performs secondary transfer of the primary transfer image onto a recording medium.

In this case, a plurality of developer images are formed on the respective photoconductors by corresponding developing devices and thereafter, are transferred to and overlap one another on the intermediate transfer belt. Accordingly, to achieve an even primary transfer image having no color deviation between the different colors of developer images when the respective developer images formed on the photoconductors are transferred to and overlap one another on the intermediate transfer belt, it may be necessary to transfer the different colors of developer images to the same position on the intermediate transfer belt.

In a conventional method, a position identification hole is formed at a predetermined position of an intermediate transfer belt, so that an image is formed on a photoconductor in response to a signal generated when a position sensor senses the position identification hole.

If the position identification hole is sensed, a first color image, for example, a yellow developer image is formed on the photoconductor under control of a light scanning device and each developing device and thereafter, the yellow developer image is transferred to the intermediate transfer belt. In this case, simultaneously with the yellow developer image being formed on the photoconductor in response to the sensing signal of the position identification hole, a cleaning blade of a cleaning unit that comes into contact with the intermediate transfer belt is moved away from the intermediate transfer belt.

Thereafter, the remaining colors of developer images are formed respectively on the photoconductor whenever the position identification hole is sensed and thereafter, are transferred to and overlap one another on the intermediate transfer belt on which the yellow developer image has been transferred.

However, differently from the formation of the remaining colors of developer images, the cleaning blade is not completely spaced apart from the intermediate transfer belt upon formation of the first developer image, i.e. the yellow developer image. Therefore, contact friction between the intermediate transfer belt and the cleaning blade may retard the rotational velocity of the intermediate transfer belt. Consequently, this may cause color discrepancy between the different colors of developer images transferred to the intermediate transfer belt. More specifically, of the plurality of images transferred to the intermediate transfer belt, the yellow developer image may appear out of alignment with magenta, cyan and black developer images.

SUMMARY

The present general inventive concept provides an image forming apparatus in which respective colors of developer images may be transferred to the same position on an intermediate transfer belt in consideration of variation in the rotational velocity of the intermediate transfer belt due to contact release between the intermediate transfer belt and a cleaning unit, and a control method thereof.

Additional features and utilities of the present general inventive concept will be set forth in part in the description which follows and, in part, will be obvious from the description, or may be learned by practice of the present general inventive concept.

Exemplary embodiments of the present general inventive concept can provide an image forming apparatus that includes a photoconductor on which a developer image is formed, an intermediate transfer member arranged such that the developer image formed on the photoconductor can be transferred thereto, a cleaning unit arranged to come into contact with the intermediate transfer member and to remove a developer residue, a cleaning unit drive device to move the cleaning unit away from the intermediate transfer member, a first position identification mark and a second position identification mark arranged in a rotation direction of the intermediate transfer member, a position sensing unit arranged on a movement path of the position identification marks to sense at least the first and second position identification marks during rotation of the intermediate transfer member, and a control unit to control the cleaning unit to be moved away from the intermediate transfer member when the first position identification mark is sensed and to form a developer image on the photoconductor and transfer the formed developer image to the intermediate transfer member when the second position identification mark is sensed.

The first position identification mark and the second position identification mark may be spaced apart from each other on one side edge of the intermediate transfer member and may include position identification holes penetrating the intermediate transfer member.

The first position identification mark may be arranged forward of the second position identification mark in the rotation direction of the intermediate transfer member.

The control unit may control the cleaning unit to be moved away from the intermediate transfer member when the first position identification mark is initially sensed.

The control unit may form a plurality of developer images to overlap one another on the intermediate transfer member.

The control unit may control the plurality of developer images formed on the intermediate transfer belt to be transferred to a surface of a printing medium to form a secondary transfer image.

The image forming apparatus can include a fusing device to fuse the secondary transfer image to the printing medium.

Exemplary embodiments of the present general inventive concept may also provide an image forming apparatus that can include a single photoconductor on which a developer image is formed, an intermediate transfer member to transfer the developer image from the photoconductor to a printing medium, a cleaning unit arranged to come into contact with the intermediate transfer member and to remove a developer residue, a cleaning unit drive device to move the cleaning unit away from the intermediate transfer member, two position identification marks spaced apart from each other by a predetermined distance in a rotation direction of the intermediate transfer member, a position sensing unit arranged on a movement path of the two position identification marks to sense the two position identification marks during rotation of the intermediate transfer member, and a control unit to control the cleaning unit to be moved away from the intermediate transfer member when one of the two position identification marks is sensed and to form a corresponding developer image on the photoconductor and transfer the formed developer image to the intermediate transfer member whenever the other position identification mark is sensed.

The two position identification marks may include a first position identification hole and a second position identification hole spaced apart from each other by the predetermined distance on one side edge of the intermediate transfer member and penetrating the intermediate transfer member.

The first position identification hole may be is sensed by the sensing unit such that the control unit controls the cleaning unit to be moved away from the intermediate transfer member and may be arranged forward of the second position identification hole in the rotation direction of the intermediate transfer member.

The control unit may control the cleaning unit to be moved away from the intermediate transfer member when the first position identification hole is initially sensed.

The control unit may control a plurality of developer images that are formed on the intermediate transfer belt to be transferred to a surface of a printing medium to form a secondary transfer image.

The image forming apparatus can include a fusing device to fuse the secondary transfer image to the printing medium.

Exemplary embodiments of the present general inventive concept may also provide in a control method of an image forming apparatus including a photoconductor on which a developer image is formed, an intermediate transfer belt to which the developer image is transferred from the photoconductor, and a cleaning unit arranged to come into contact with the intermediate transfer belt and to remove a developer residue, the control method includes sensing a first position identification mark formed on the intermediate transfer belt, moving the cleaning unit away from the intermediate transfer belt when the first position identification mark is sensed, sensing a second position identification mark spaced apart from the first position identification mark in a rotation direction of the intermediate transfer belt, and forming the developer image on the photoconductor and transferring the formed developer image to the intermediate transfer belt when the second position identification mark is sensed.

The cleaning unit, arranged to come into contact with the intermediate transfer belt and to remove the developer residue, may be moved away from the intermediate transfer belt when the first position identification mark, which is arranged forward of the second position identification mark in the rotation direction of the intermediate transfer belt, is sensed.

The cleaning unit may be moved away from the intermediate transfer belt only when the first position identification mark is initially sensed.

The control method can include where the plurality of developer images have at least two developer images having different colors.

The control method can further include transferring the plurality of developer images formed on the intermediate transfer belt to a surface of a printing medium to form a secondary transfer image.

The control method can further include fusing the secondary transfer image to the printing medium with a fusing apparatus of the image forming apparatus.

Exemplary embodiments of the present general inventive concept also provide a method of controlling an image forming apparatus, the method including moving a cleaning unit away from an intermediate transfer belt of the image forming apparatus when a first position identification mark disposed on the intermediate transfer belt is detected, detecting a second position identification mark spaced apart from the first position identification mark in a rotation direction of the intermediate transfer belt, and transferring a developer image from a photoconductor of the image forming apparatus to the intermediate transfer belt when the second position identification mark is detected.

The method may also include transferring the developer image formed on the intermediate transfer belt to a surface of a printing medium to form a secondary transfer image.

The method may also include detecting the second position identification mark when the intermediate transfer belt has rotated, forming a second developer image having a second color, transferring the second developer image from a photoconductor of the image forming apparatus to the intermediate transfer belt when the second position identification mark is detected, and transferring the second developer image formed on the intermediate transfer belt to a surface of a printing medium to form a secondary transfer image.

Exemplary embodiments of the present general inventive concept also provide an image forming apparatus, including a photoconductor, a transfer member to receive a developer image formed on the photoconductor, the transfer member including a first position identification mark and a second position identification mark arranged in a rotation direction of the transfer member, a moveable cleaning unit moveable between a contact position with the transfer member and to remove residue therefrom and a separation position therefrom, a position sensing unit to sense a position of the first and second position identification marks, and a control unit to move the cleaning unit between the position in contact with the transfer member and the separation position based on sensed positions of the first and second position identification marks.

The image forming apparatus may also include where the control unit forms a plurality of developer images that overlap one another on the transfer member.

The image forming apparatus may also include where the control unit controls the plurality of developer images formed on the transfer member to be transferred to a surface of a printing medium.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
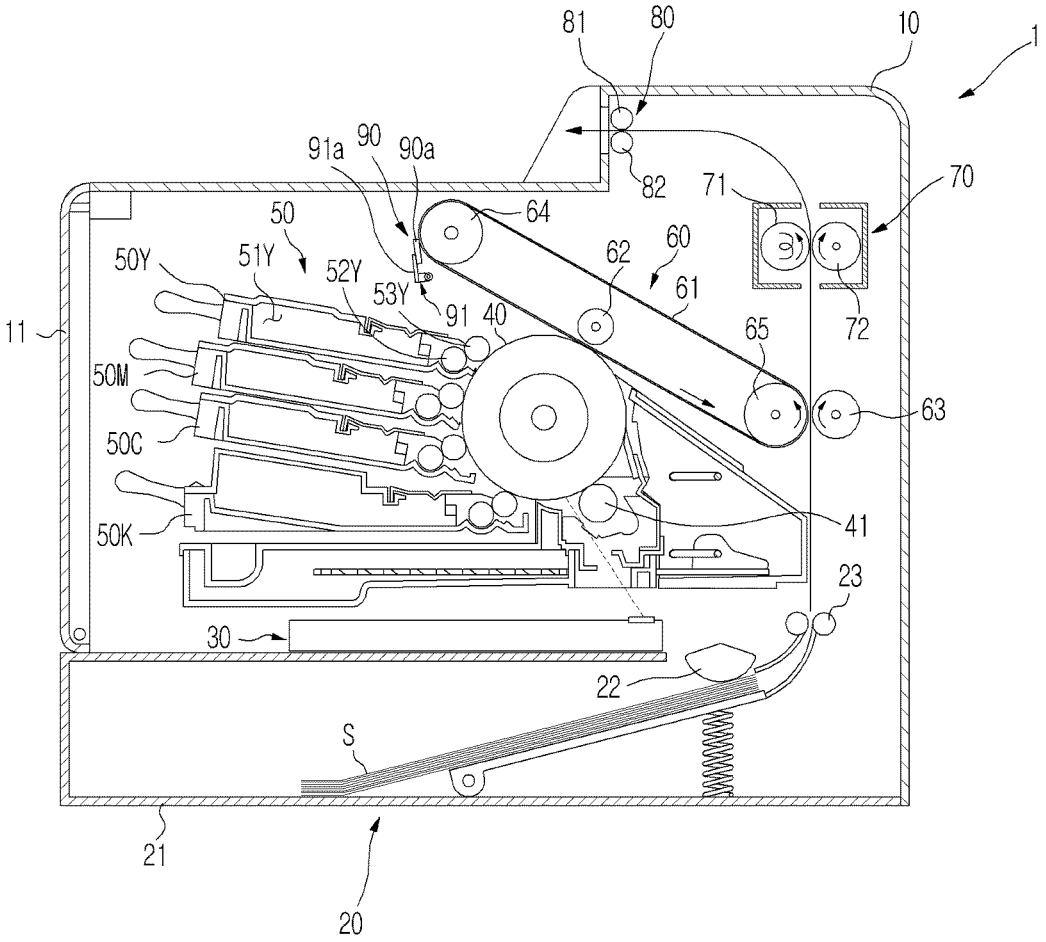
FIG. 1 is a view illustrating a schematic of an image forming apparatus according to exemplary embodiments of the present general inventive concept.

Reference will now be made in detail to the embodiments of the present invention, examples of which are illustrated in the accompanying drawings, wherein like reference numerals refer to like elements throughout. The embodiments are described below in order to explain the present general inventive concept by referring to the figures.

FIG. 1 is a view illustrating a schematic of an image forming apparatus according to exemplary embodiments of the present general inventive concept.

As illustrated in FIG. 1, the image forming apparatus 1 according to exemplary embodiments of the present general inventive concept can include a body 10, a printing medium supply device 20, a light scanning device 30, a photoconductor 40, a developing device 50, a transfer device 60, a fusing device 70, and a printing medium discharge device 80.

The body 10 can provide at least an external appearance of the image forming apparatus 1, and supports a plurality of elements installed therein, as discussed in detail below. A body cover 11 can be pivotally rotatably coupled to one side of the body 10. The body cover 11 can open and close a part of the body 10.

The printing medium supply device 20 can supply a printing medium S toward the transfer device 60. The printing medium S can be one or more sheets of paper, or any other suitable medium on which to print images according to exemplary embodiments of the present general inventive concept as disclosed herein. The printing medium supply device 20 can include a cassette 21 in which the printing medium S is stored, a pickup roller 22 to pick up the printing medium S stored in the cassette 21 sheet by sheet, and a feed roller 23 to feed the picked-up printing medium S toward the transfer device 60.

The light scanning device 30 can be arranged below the developing device 50 to irradiate light corresponding to image information to the photoconductor 40 so as to form an electrostatic latent image on a surface of the photoconductor 40.

The photoconductor 40 can be formed of a photoconductive layer on a cylindrical metallic drum. The photoconductor 40 can be an image carrier to carry the electrostatic latent image formed by the light scanning device 30 and a developer image formed by the developing device 50 thereon. The photoconductor 40 can be rotatably mounted inside the body 10.

A charge roller 41 can be mounted inside the body 10. The charge roller 41 can charge the photoconductor 40 with a predetermined electric potential before the light scanning device 30 irradiates light to the photoconductor 40. The charge roller 41 can be one example of a charger to charge the photoconductor 40 with an electric potential (e.g., the photoconductor 40 is evenly charged with an electrical potential). The charge roller 41 can supply electric charge when being rotated in contact with or not in contact with an outer peripheral surface of the photoconductor 40, thereby charging the outer peripheral surface of the photoconductor 40 with an even electric potential. Alternatively, a corona discharge device may be used instead of the charge roller 41.

The developing device 50 can form a developer image by supplying developer to the photoconductor 40 on which the electrostatic latent image has been formed. The developing device 50 can include, for example, four developing units 50Y, 50M, 50C, and 50K, in which different colors of developers, for example, yellow developer Y, magenta developer M, cyan developer C and black developer K are received respectively.

The developing units 50Y, 50M, 50C, and 50K respectively can include developer reservoirs 51Y, 51M, 51C and 51K, supply rollers 52Y, 52M, 52C and 52K, and developing rollers 53Y, 53M, 53C and 53K. The developer reservoirs 51Y, 51M, 51C and 51K can store developers to be supplied to the photoconductor 40. The supply rollers 52Y, 52M, 52C and 52K can supply the developers stored in the developer reservoirs 51Y, 51M, 51C and 51K to the developing rollers 53Y, 53M, 53C and 53K. The developing rollers 53Y, 53M, 53C and 53K can attach the developers to the surface of the photoconductor 40 on which the electrostatic latent image has been formed, to form developer images. The developer reservoirs 51Y, 51M, 51C and 51K respectively hold yellow developer Y, magenta developer M, cyan developer C and black developer K. The supply rollers 52Y, 52M, 52C and 52K, and the developing rollers 53Y, 53M, 53C and 53K can have yellow developer Y, magenta developer M, cyan developer C and black developer K on their surfaces, respectively.

The transfer device 60 can include an intermediate transfer belt 61, a first transfer roller 62 and a second transfer roller 63.

The intermediate transfer belt 61 can be an image carrier to carry the developer images formed by the developing device 50 thereon. The intermediate transfer belt 61 can be supported by supporting rollers 64 and 65 and can travel at the same velocity as the linear velocity of the photoconductor 40. The length of the intermediate transfer belt 61 can be equal to or greater than the length of the printing medium S of a maximum size used in the image forming apparatus 1.

The first transfer roller 62 can face the photoconductor 40 with the intermediate transfer belt 61 interposed therebetween, and can transfer the developer images formed on the photoconductor 40 to the intermediate transfer belt 61. A first transfer bias voltage to transfer the developer images formed on the photoconductor 40 to the intermediate transfer belt 61 can be applied to the first transfer roller 62. A controller (e.g., control unit 120 illustrated in FIG. 4 and described below) can control the application of the first transfer bias voltage. The first transfer bias voltage can have a polarity opposite to that of the developers. When the first transfer bias voltage is applied to the first transfer roller 62, the respective developer images formed on the surface of the photoconductor 40 can be transferred to and overlap one another on the intermediate transfer belt 61, thus forming a primary transfer image.

The second transfer roller 63 can face the supporting roller 65 with the intermediate transfer belt 61 interposed therebetween. The second transfer roller 63 can be spaced apart from the intermediate transfer belt 61 when the developer images are transferred from the photoconductor 40 to the intermediate transfer belt 61, but is brought into contact with the intermediate transfer belt 61 at a predetermined contact pressure after the developer images of the photoconductor 40 are completely transferred to the intermediate transfer belt 61. When the second transfer roller 63 comes into contact with the intermediate transfer belt 61, the developer images on the intermediate transfer belt 61 can be transferred to the printing medium S. A second transfer bias voltage to transfer the developer images to the printing medium S can be applied to the second transfer roller 63. A controller (e.g., control unit 120 illustrated in FIG. 4 and described below) can control the application of the second transfer bias voltage. The second transfer bias voltage can have a polarity opposite to that of the developers. When the second transfer bias voltage is applied to the second transfer roller 63, the primary transfer image formed on the intermediate transfer belt 61 can be transferred to the printing medium S fed by the printing medium supply device 20 to form a secondary transfer image on the printing medium S.

The fusing device 70 can include a heating roller 71 having a heat source and a press roller 72 installed to face the heating roller 71. When the printing medium S passes between the heating roller 71 and the press roller 72, the image can be fixed to the printing medium S by heat transferred from the heating roller 71 and pressure acting between the heating roller 71 and the press roller 72.

The printing medium S discharge device 80 can include a discharge roller 81 and a discharge backup roller 82 to discharge the printing medium S having passed through the fusing device 70 outside the body 10.

The image forming apparatus 1 according to the exemplary embodiments of the present general inventive concept can include a cleaning unit 90 that can come into contact with the intermediate transfer belt 61 and a cleaning unit drive device 91 to pivotally rotate the cleaning unit 90.

The cleaning unit 90 can include a cleaning blade 90*a* to scrape waste developer remaining on a surface of the intermediate transfer belt 61 via friction with the intermediate transfer belt 61. The cleaning blade 90*a* can be made of an elastic material and can scrape the waste developer when in contact with the intermediate transfer belt 61. Instead of the cleaning unit 90 using the cleaning blade 90*a*, a brush type or roller type cleaning unit may be included in the cleaning unit 90.

The cleaning unit drive device 91 can rotate the cleaning unit 90 about a rotating shaft 91*a* thereof to separate the cleaning unit 90 that can make contact with the intermediate transfer belt 61 from the intermediate transfer belt 61.

Hereinafter, operation of the image forming apparatus having the above described configuration will be described in brief.

When a printing operation begins, the charge roller 41 can charge the surface of the photoconductor 40 with an even electric potential. When the surface of the photoconductor 40 is evenly charged, the light scanning device 30 can irradiate light corresponding to information of any one color image, e.g., a yellow image to the surface of the photoconductor 40.

Thereby, an electrostatic latent image corresponding to the yellow image can be formed on the photoconductor 40.

A developing bias can be applied to the developing roller 53 of the yellow developing unit 50Y, such that the yellow developer can be attached to the electrostatic latent image and form the yellow developer image on the photoconductor 40. The developer image can be transferred to the intermediate transfer belt 61 by the first transfer roller 62.

When transfer of the yellow image belonging to one page is completed, the light scanning device 30 can irradiate light corresponding to information of another color image, e.g., magenta image to the photoconductor 40, thus forming an electrostatic latent image corresponding to the magenta image. The magenta developing unit 50M can supply magenta developer to the electrostatic latent image to form a magenta developer image. The magenta developer image formed on the photoconductor 40 can be transferred to the intermediate transfer belt 61 by the first transfer roller 62. The magenta developer image can overlap the yellow developer image that was previously transferred to the intermediate transfer belt 61.

As the above described operation is repeated for cyan and black images, the primary color image in which the yellow, magenta, cyan and black images overlap one above another can be formed on the intermediate transfer belt 61. The resulting color image can be transferred to the printing medium S passing between the intermediate transfer belt 61 and the second transfer roller 63, and the printing medium S can be discharged outside the body 10 by way of the fusing device 70 and the printing medium discharge device 80. In exemplary embodiments of the present general inventive concept, the yellow, magenta, cyan, and black images may be disposed on the printing medium S in any suitable order (e.g., any one of the yellow, magenta cyan or black images can be disposed first on the printing medium S) and may be overlapped.

Figure 2:
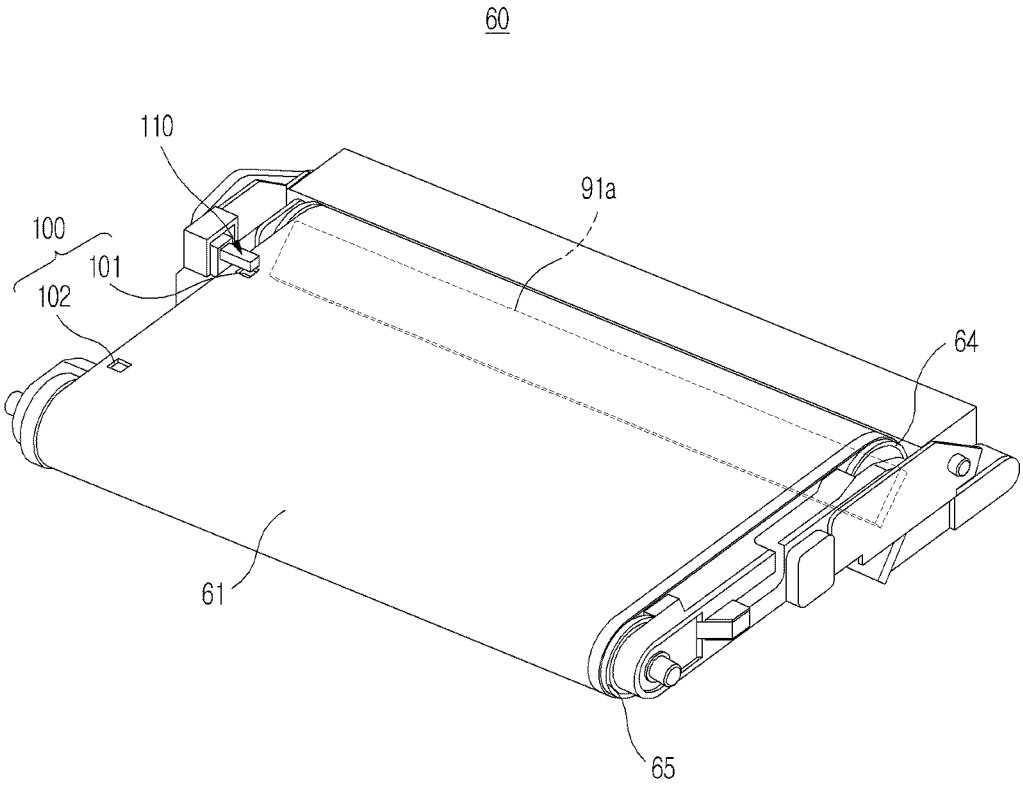
FIG. 2 is a perspective view illustrating a transfer device illustrated in FIG. 1 according to exemplary embodiments of the present general inventive concept.
Figure 3:
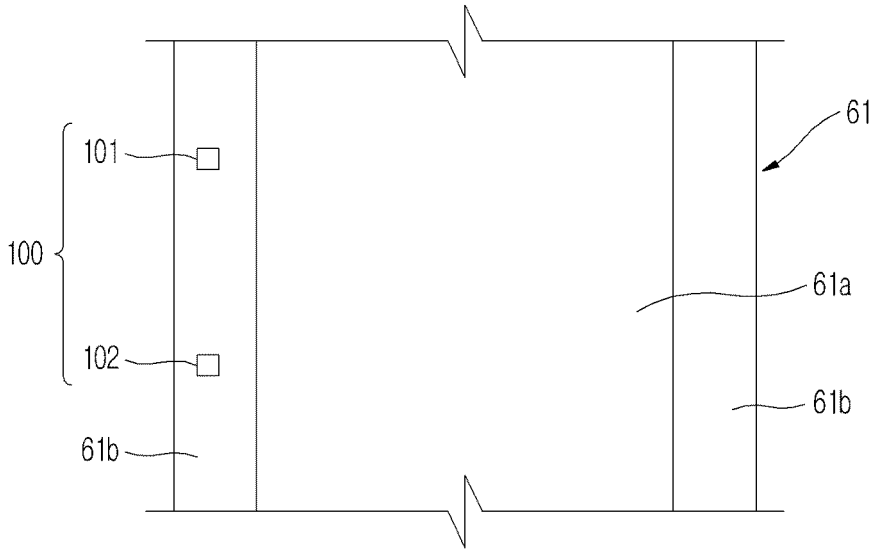
FIG. 3 is a partial plan view illustrating position identification marks provided at an intermediate transfer belt illustrated in FIG. 2 according to exemplary embodiments of the present general inventive concept.

FIG. 2 illustrates a perspective view of the transfer device 60 illustrated in FIG. 1, and FIG. 3 illustrates position identification marks provided at the intermediate transfer belt 61 illustrated in FIG. 2 according to exemplary embodiments of the present general inventive concept.

As illustrated in FIG. 2, the intermediate transfer belt 61 can be driven while being supported by the supporting rollers 64 and 65 provided at both sides thereof.

Position identification marks 100 can be formed at a side edge of the intermediate transfer belt 60. A position sensing unit 110 can be provided on a movement path of the position identification marks 100.

The position identification marks 100 can include two position identification marks 101 and 102 longitudinally spaced apart from each other by a predetermined distance at the side edge of the intermediate transfer belt 61.

Figure 4:
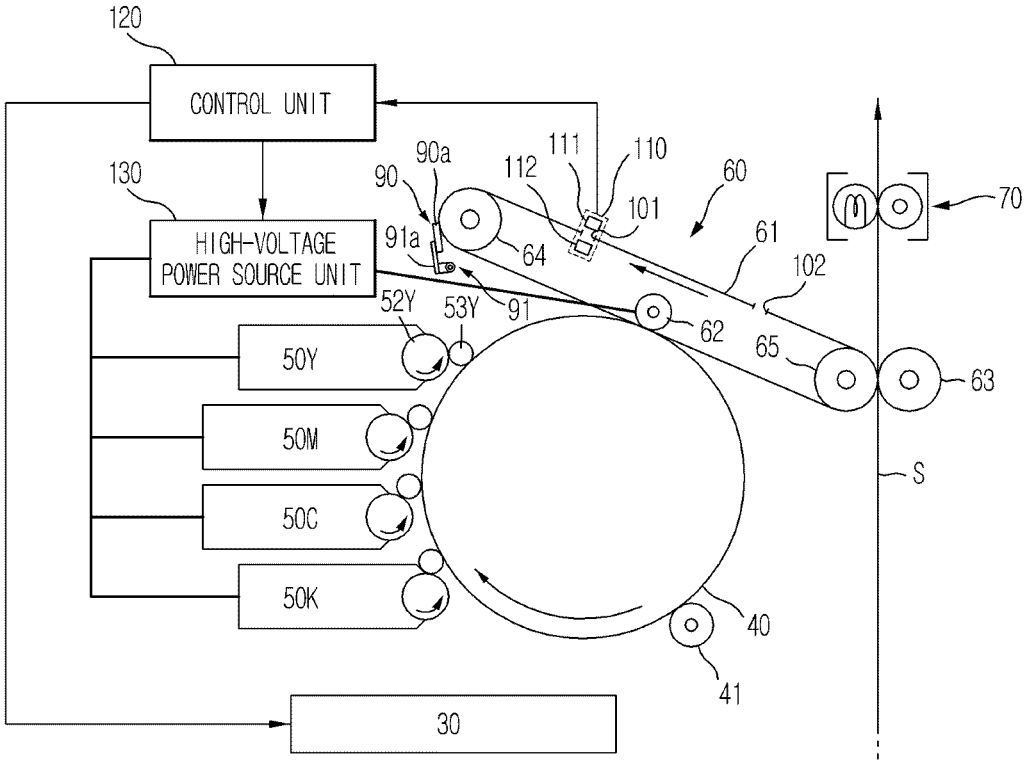
FIG. 4 is a view illustrating an operation of detecting a first one of the position identification marks provided at the intermediate transfer belt using a position sensing unit according to exemplary embodiments of the present general inventive concept.

The position sensing unit 110 can include a position detecting sensor, such as a photo sensor, including a light emitting element 111 and a light receiving element 112, the light emitting element 111 and the light receiving element 112 being arranged on the movement path of the position identification marks 101 and 102 by an interval to detect the position identification marks 101 and 102 interposed therebetween (See FIG. 4).

As illustrated in FIG. 3, the intermediate transfer belt 61 can include a photoconductive layer 61*a* having increased transfer efficiency, and a protective layer 61*b* formed at both edges of the photoconductive layer 61*a*. The photoconductive layer 61*a* can be provided at an outer surface thereof with an increased resistance (e.g., a high-resistance) coating layer having an increased volume-resistance (e.g., a high volume-resistance) to minimize and/or prevent image blurring.

The position identification marks 100 can be square and/or rectangular slits or holes penetrating the photoconductive layer 61*a* and the protective layer 61*b* of the intermediate transfer belt 61.

Figure 5:
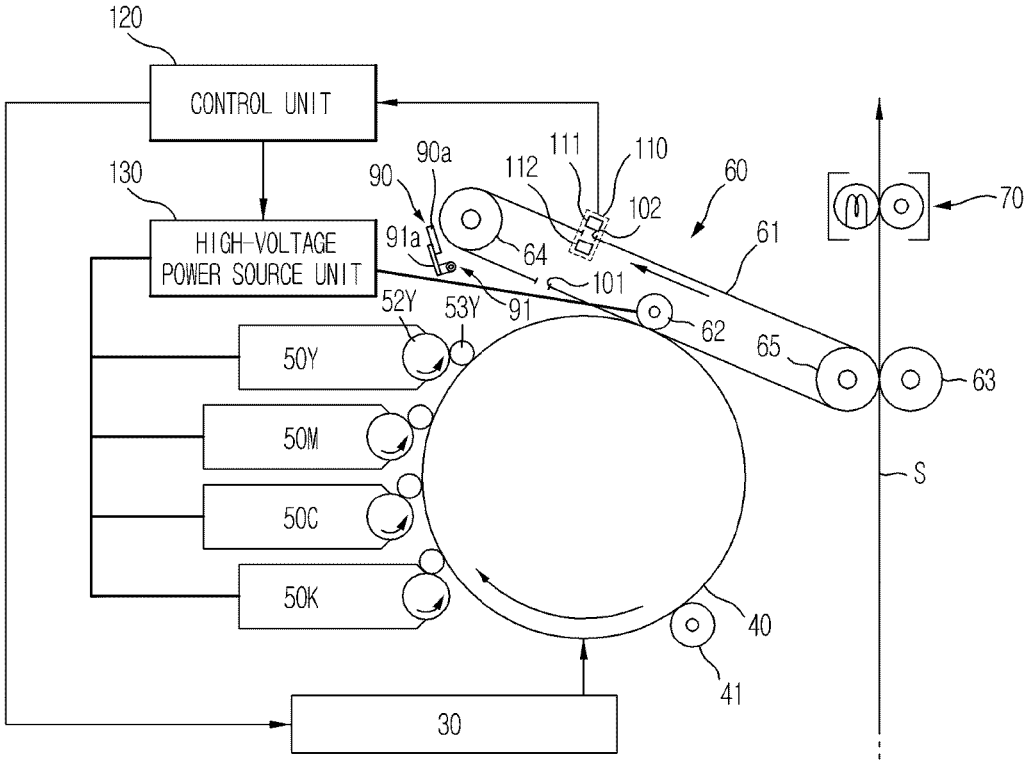
FIG. 5 is a view illustrating an operation of detecting a second one of the position identification marks provided at the intermediate transfer belt using the position sensing unit according to exemplary embodiments of the present general inventive concept.

FIG. 4 illustrates an operation of the cleaning blade when the first position identification mark (e.g., the position identification mark 101 or the position identification mark 102, illustrated in FIGS. 2 and 3) provided at the intermediate transfer belt (e.g., intermediate transfer belt 61 illustrated in FIGS. 2 and 3) is detected by the position sensing unit (e.g., position sensing unit 110 illustrated in FIG. 2), and FIG. 5 illustrates an operation of the cleaning blade (e.g., cleaning blade 90*a*) when the second position identification mark provided at the intermediate transfer belt is detected by the position sensing unit according to exemplary embodiments of the present general inventive concept.

As illustrated in FIGS. 4 and 5, a control unit 120 to control one or more operations of the image forming apparatus 1, including the high-voltage power source unit 130, can receive position information of the intermediate transfer belt 61 from the position sensing unit 110.

If a print command is input (e.g., if a print command is received by the control unit 120), the control unit 120 can rotate the intermediate transfer belt 61 via rotation of the driving roller 65 and thereafter, in response to a sensing signal generated when the position sensing unit 110 initially detects the first position identification mark 101, can move the cleaning blade 91 away from the intermediate transfer belt 61 that comes into contact with the intermediate transfer belt 61.

When the intermediate transfer belt 61 is continuously rotated when spaced apart from the cleaning blade 90*a*, in response to a sensing signal generated when the position sensing unit 110 detects the second position identification mark 102 spaced apart from the first position identification mark 101 by a predetermined distance, the control unit 120 can form an electrostatic latent image on the photoconductor 40 and can attach developer to the electrostatic latent image to form a developer image on the photoconductor 40. Under the control of the control unit 120, the yellow, magenta, cyan and black developing units 50Y, 50M, 50C and 50K can form developer images respectively on the photoconductor 40 and, in turn, the developer images can be transferred to and overlap one another on the intermediate transfer belt 61.

More specifically, if the position sensing unit 110 initially detects the first position identification mark 101 via rotation of the intermediate transfer belt 61, the control unit 120 can drive the cleaning unit drive device 91 to release contact between the intermediate transfer belt 61 and the cleaning blade 90*a*, so that the cleaning blade 90*a* can be moved away from the intermediate transfer belt 61.

When the position sensing unit 102 detects the second position identification mark 102 via continuous rotation of the intermediate transfer belt 61 spaced apart from the cleaning blade 90*a*, the control unit 120 can control the light scanning device 30 and the first developing unit (e.g., the yellow developing unit 50Y), to begin formation of the electrostatic latent image and the developer image on the photoconductor 40. Specifically, when the position sensing unit 110 initially detects the second position identification mark 102, the control unit 120 can control the light scanning device 30 and the yellow developing unit 50Y to begin formation of the electrostatic latent image and the yellow developer image at an image formation beginning position on the photoconductor 40.

Accordingly, the image can be formed on the photoconductor 40 and can be transferred to the intermediate transfer belt 61 on the basis of a sensing time of the second position identification mark 102 when the cleaning blade 90*a* is spaced apart from the intermediate transfer belt 61 in response to the sensing signal of the first position identification mark 101. Therefore, the cleaning blade 90*a* does not act to retard the rotational velocity of the intermediate transfer belt 61 during formation of the image and the respective colors of developer images may be transferred to the same position on the intermediate transfer belt 61. This may reduce and/or prevent color discrepancy between the respective colors of developer images transferred to overlap one another on the intermediate transfer belt 61.

When a transfer beginning position of the yellow developer image on the intermediate transfer belt 61 engages with the image formation beginning position on the photoconductor 40 in a first transfer nip between the intermediate transfer belt 61 and the photoconductor 40 via rotation of the intermediate transfer belt 61 and the photoconductor 40, the control unit 120 can apply the first transfer bias voltage to the first transfer roller 62. The yellow developer image formed on the photoconductor 40 can be transferred to the intermediate transfer belt 61.

When the yellow developer image is transferred from the photoconductor 40 to the intermediate transfer belt 61, the control unit 120 can control the light scanning device 30 and the magenta developing unit 50Y to begin formation of the electrostatic latent image and the magenta developer image at the image formation beginning position on the photoconductor 40 when the position sensing unit 110 detects the second position identification mark 102 (e.g., when the position sensing unit 110 detects the second position identification mark 102 twice).

When a transfer beginning position of the magenta developer image on the intermediate transfer belt 61 engages with the image formation beginning position on the photoconductor 40 in the first transfer nip between the intermediate transfer belt 61 and the photoconductor 40 via rotation of the intermediate transfer belt 61 and the photoconductor 40, the control unit 120 can apply the first transfer bias voltage to the first transfer roller 62. The magenta developer image formed on the photoconductor 40 can be transferred to and can overlap the yellow developer image on the intermediate transfer belt 61.

Thereafter, the control unit 120 can control the formation of the remaining color images, e.g., cyan and black developer images in the same manner as the formation and transfer of the magenta developer image.

As described above, if the position sensing unit 110 initially detects the first position identification mark 101 on the intermediate transfer belt 61 after the print command is input, the control unit 120 can drive the cleaning unit drive device 91 to move the cleaning blade 90*a* away from the intermediate transfer belt 61. When the second position identification mark 102 on the intermediate transfer belt 61 is detected in a state where the cleaning blade 90*a* is spaced apart from the intermediate transfer belt 61, the control unit 120 can form the respective developer images on the photoconductor 40 and can transfer the developer images to the same position on the intermediate transfer belt 61 so that the developer images overlap one another.

Accordingly, as the respective colors of developer images are transferred to the same position of the intermediate transfer belt, the resulting primary transfer image on the intermediate transfer belt may exhibit reduced no color discrepancy and/or no color discrepancy.

Figure 6A:
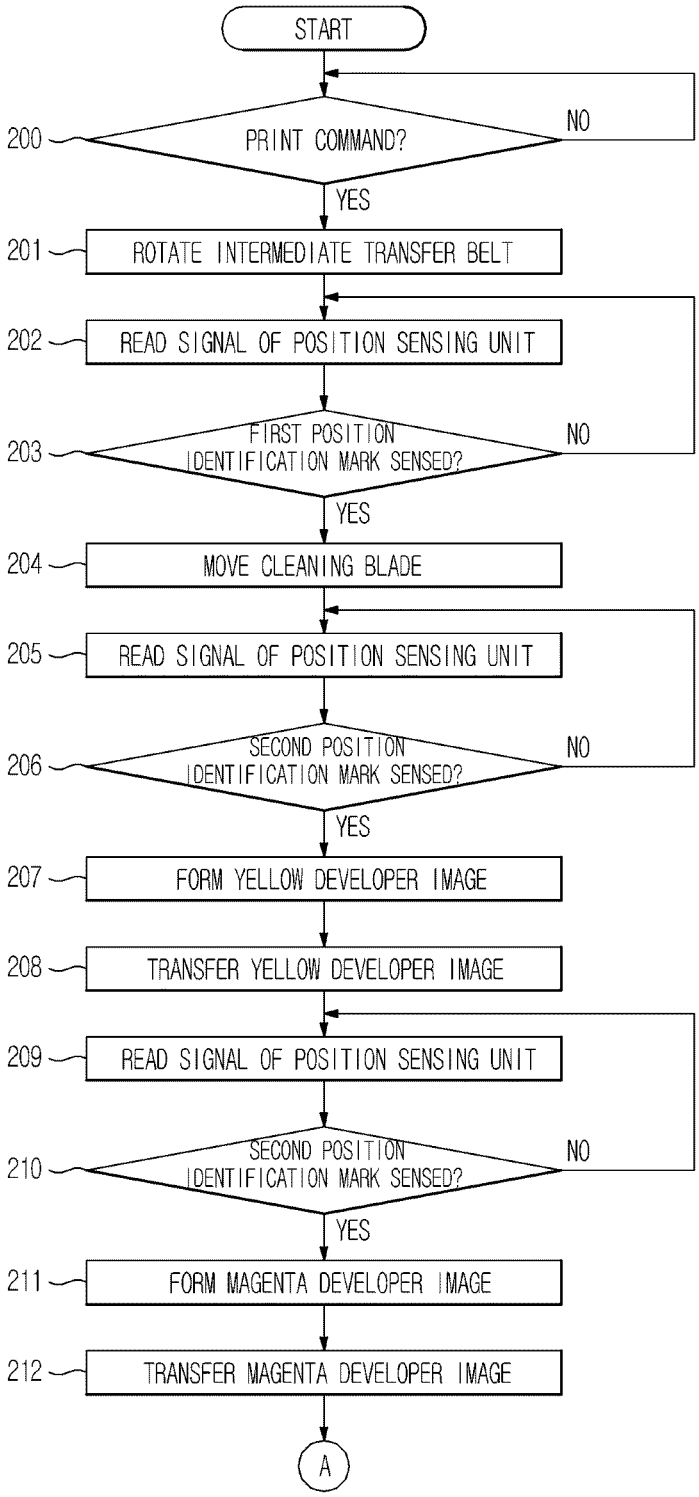
FIGS. 6A and 6B are control flow charts illustrating a control method of an image forming apparatus according to exemplary embodiments of the present general inventive concept.
Figure 6B:
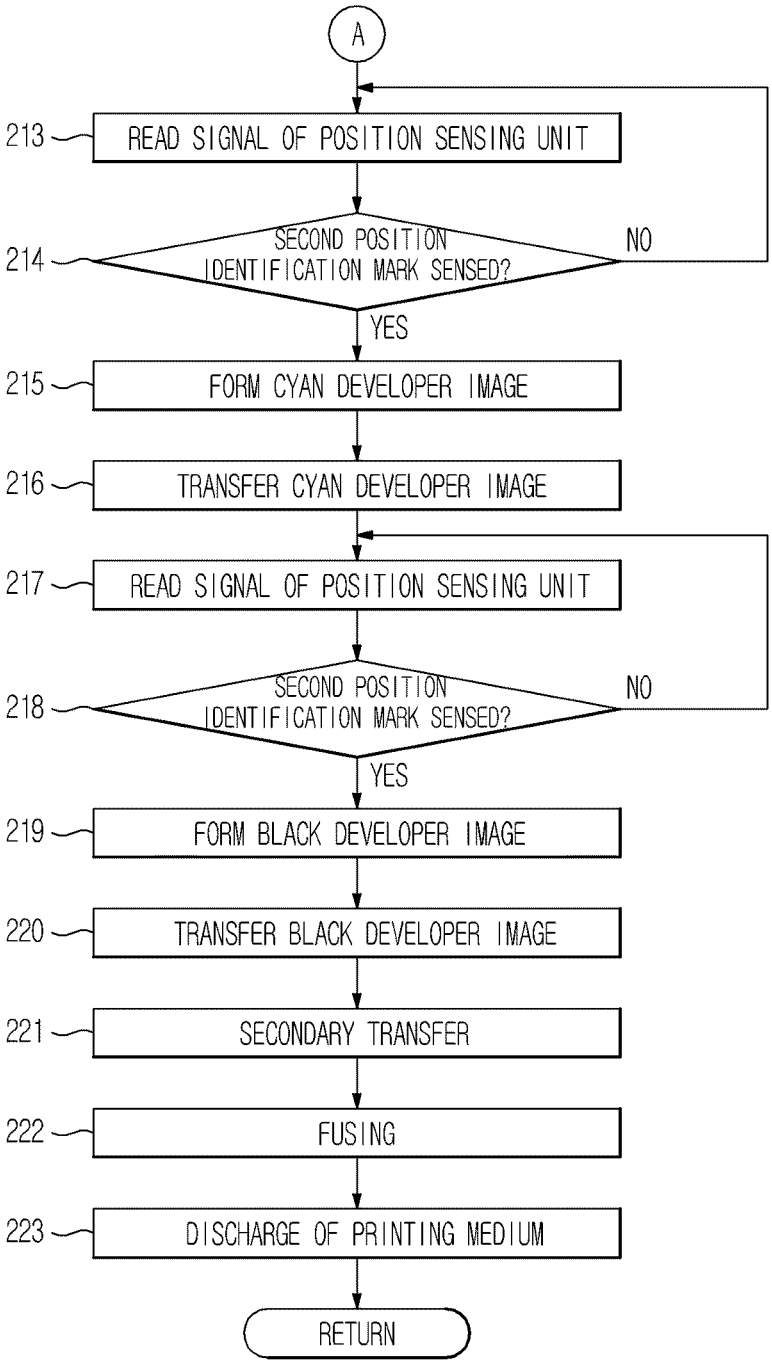

Hereinafter, a printing operation of the image forming apparatus according to exemplary embodiments of the present general inventive concept will be described with reference to FIGS. 6A and 6B.

When a print command is input at operation 200, the control unit 120 can rotate the driving roller 65 to rotate the intermediate transfer belt 61 at operation 201.

During rotation of the intermediate transfer belt 61, the control unit 120 can read signals of the position sensing unit 110 to sense the first position identification mark 101 at operation 202.

When reading the signals from the position sensing unit 110, the control unit 120 can determine whether or not the first position identification mark 101 is sensed according to the signals from the position sensing unit 110 at operation 203.

When the sensing of the first position identification mark 101 is determined at operation 203, the control unit 120 can drive the cleaning unit drive device 91, causing the cleaning blade 90*a* that comes into contact with the intermediate transfer belt 61, to be moved away from the intermediate transfer belt 61 at operation 204. Although the rotational velocity of the intermediate transfer belt 61 may be lower than a normal velocity due to friction between the cleaning blade 90*a* and the intermediate transfer belt 61 when the intermediate transfer belt 61 is rotated while coming into contact with the cleaning blade 90*a*, in exemplary embodiments of the present general inventive concept, the intermediate transfer belt 61 may be rotated at a normal velocity because of contact release between the cleaning blade 90*a* and the intermediate transfer belt 61 being rotated.

When the cleaning blade 90*a* is spaced apart from the intermediate transfer belt 61, the control unit 120 can read the signals of the position sensing unit 110 to sense the second position identification mark 102 at operation 205.

When reading the signals from the position sensing unit 110, the control unit 120 can determine whether or not the second position identification mark 102 is sensed based on the signals from the position sensing unit 110 at operation 206.

When the sensing of the second position identification mark 102 is determined from operation mode 206, the control unit 120 can form a yellow developer image on the photoconductor 40 at operation 207 and transfers the formed yellow developer image to the intermediate transfer belt 61 at operation 208.

When the yellow developer image is transferred to the intermediate transfer belt 61, the control unit 120 can read the signals of the position sensing unit 110 to repeatedly sense the second position identification mark 102 at operation 209. Of all the signals of the position sensing unit 100, the sensing signal of the first position identification mark 101 can be neglected. For example, this may be confirmed by counting the sequence of signals.

When reading the signals of the position sensing unit 110, the control unit 120 can determine whether or not the second position identification mark 102 is sensed according to the signals from the position sensing unit 110 at operation 210.

When the sensing of the second position identification mark 102 is judged from operation mode 210, the control unit 120 can form a magenta developer image on the photoconductor 40 at operation 211 and can transfer the formed magenta developer image to the intermediate transfer belt 61 on which the yellow developer image has been transferred at operation 212. In this case, the yellow developer image and the magenta developer image can be formed and transferred on the basis of the same position on the intermediate transfer belt and thus may have reduced and/or no color discrepancy.

Thereafter, the control unit 120 can form a cyan developer image and can transfer the formed cyan developer image to the intermediate transfer belt 61 in the same manner as the above described magenta developer image by performing operation 213 to 216. That is, the signal of the position sensing unit 110 can be read at operation 213 by the control unit 120, and a determination as to whether the second position identification mark is sensed can be made at operation 214 by the control unit 120. When the second position identification mark 102 is sensed according to the signals of the position sensing unit 110, the control unit 120 can form a cyan developer image can be formed on the photoconductor 40 at operation 215, which can be transferred at operation 216 to the intermediate transfer belt 61.

Also, the control unit 120 can form a black developer image and can transfer the formed black developer image to the intermediate transfer belt 61 in the same manner as the above described magenta or cyan developer image by performing operation 217 to 220. That is, the signal of the position sensing unit 110 can be read at operation 217 by the control unit 120, and a determination as to whether the second position identification mark is sensed can be made at operation 218 by the control unit 120. When the second position identification mark 102 is sensed according to the signals of the position sensing unit 110, the control unit 120 can form a black developer image can be formed on the photoconductor 40 at operation 219, which can be transferred at operation 220 to the intermediate transfer belt 61.

The yellow, magenta, cyan and black developer images can be transferred to and overlap one another on the intermediate transfer belt 61, forming a primary transfer image on the intermediate transfer belt 61.

When the primary transfer image is formed on the intermediate transfer belt 61, the control unit 120 can apply the second transfer bias voltage to the second transfer roller 63 when the printing medium S picked up by the printing medium supply device 20 is fed into a second transfer nip between the intermediate transfer belt 61 and the second transfer roller 63, so that the primary transfer image formed on the intermediate transfer belt 61 can be transferred to an upper surface of the printing medium S and resulting in formation of a secondary transfer image at operation 221.

After completion of the secondary transfer, the control unit 120 can fuse the secondary transfer image transferred to the upper surface of the printing medium S via the fusing device 70 operation 222.

After fusing of the secondary transfer image, the control unit 120 can discharge the printing medium S via the printing medium discharge device 80 at operation 223.

Thereafter, the control unit 120 can repeat the above operations 200 to 223 when there is a following print page, or can complete the printing operation when there is no following print page.

As apparent from the above description, according to exemplary embodiments of the present general inventive concept, an intermediate transfer member can be provided with a position identification mark so as to sense a position of the intermediate transfer member when a cleaning unit is spaced apart from the intermediate transfer member. An image formation/transfer position can be controlled in response to a sensing signal of the position identification mark, so that respective colors of developer images may be formed and transferred to the same position on the intermediate transfer member in a state in which contact between the cleaning unit and the intermediate transfer member is released. This may reduce and/or prevent color discrepancy between the respective colors of developer images.

Although several embodiments of the present general inventive concept have been illustrated and described, it would be appreciated by those skilled in the art that changes may be made in these embodiments without departing from the principles and spirit of the general inventive concept, the scope of which is defined in the claims and their equivalents.

What is claimed is:

1. An image forming apparatus comprising:

a photoconductor on which a developer image is formed;

an intermediate transfer member arranged such that the developer image formed on the photoconductor is transferred thereto;

a cleaning unit arranged to come into contact with the intermediate transfer member and to remove a developer residue;

a cleaning unit drive device to move the cleaning unit away from the intermediate transfer member;

a first position identification mark and a second position identification mark arranged in a rotation direction of the intermediate transfer member;

a position sensing unit arranged on a movement path of the position identification marks to sense at least the first and second position identification marks during rotation of the intermediate transfer member; and a control unit to control the cleaning unit to move away from the intermediate transfer member in response to the first position identification mark being sensed and to form a developer image on the photoconductor and transfer the formed developer image to the intermediate transfer member in response to the second position identification mark being sensed, wherein a sensing time of the second position identification mark is a time when the cleaning unit is spaced apart from the intermediate transfer belt, and wherein the position sensing unit senses a predetermined number of the second position identification marks, such that the sensed first position identification mark is ignored so that the position sensing unit can sense the predetermined number of the second position identification marks.

2. The image forming apparatus according to claim 1, wherein the first position identification mark and the second position identification mark are spaced apart from each other on one side edge of the intermediate transfer member and include position identification holes penetrating the intermediate transfer member.

3. The image forming apparatus according to claim 2, wherein the first position identification mark is arranged forward of the second position identification mark in the rotation direction of the intermediate transfer member.

4. The image forming apparatus according to claim 1, wherein the control unit controls the cleaning unit to be moved away from the intermediate transfer member when the first position identification mark is initially sensed.

5. The image forming apparatus according to claim 1, wherein the control unit forms a plurality of developer images that overlap one another on the intermediate transfer member.

6. The image forming apparatus according to claim 5, wherein the control unit controls the plurality of developer images formed on the intermediate transfer member to be transferred to a surface of a printing medium to form a secondary transfer image.

7. The image forming apparatus according to claim 6, further comprising:

a fusing device to fuse the secondary transfer image to the printing medium.

8. An image forming apparatus comprising:

a single photoconductor on which a developer image is formed;

an intermediate transfer member to transfer the developer image from the photoconductor to a printing medium;

a cleaning unit arranged to come into contact with the intermediate transfer member and to remove a developer residue;

a cleaning unit drive device to move the cleaning unit away from the intermediate transfer member;

two position identification marks spaced apart from each other by a predetermined distance in a rotation direction of the intermediate transfer member;

a position sensing unit arranged on a movement path of the two position identification marks to sense the two position identification marks during rotation of the intermediate transfer member; and a control unit to control the cleaning unit to move away from the intermediate transfer member in response to one of the two position identification marks being sensed and to form a corresponding developer image on the photoconductor and transfer the formed developer image to the intermediate transfer member in response to whenever the other position identification mark is sensed, wherein a sensing time of the other position identification mark is a time when the cleaning unit is spaced apart from the intermediate transfer belt, wherein the position sensing unit senses a predetermined number of the other position identification marks, such that the sensed one position identification mark is ignored so that the position sensing unit can sense the predetermined number of the other position identification marks.

9. The image forming apparatus according to claim 8, wherein the two position identification marks include a first position identification hole and a second position identification hole spaced apart from each other by the predetermined distance on one side edge of the intermediate transfer member and penetrating the intermediate transfer member.

10. The image forming apparatus according to claim 9, wherein the first position identification hole is sensed by the position sensing unit such that the control unit controls the cleaning unit to be moved away from the intermediate transfer member and is arranged forward of the second position identification hole in the rotation direction of the intermediate transfer member.

11. The image forming apparatus according to claim 10, wherein the control unit controls the cleaning unit to be moved away from the intermediate transfer member when the first position identification hole is initially sensed.

12. The image forming apparatus according to claim 8, wherein the control unit forms a plurality of developer images that overlap one another on the intermediate transfer member.

13. The image forming apparatus according to claim 12, wherein the control unit controls the plurality of developer images formed on the intermediate transfer member to be transferred to a surface of the printing medium to form a secondary transfer image.

14. The image forming apparatus according to claim 13, further comprising:

a fusing device to fuse the secondary transfer image to the printing medium.

15. A control method of an image forming apparatus comprising a photoconductor on which a developer image is formed, an intermediate transfer belt to which the developer image is transferred from the photoconductor, and a cleaning unit arranged to come into contact with the intermediate transfer belt and to remove a developer residue and a position sensing unit, the control method comprising:

sensing a first position identification mark formed in a protective layer portion of the intermediate transfer belt;

moving the cleaning unit away from the intermediate transfer belt in response to the first position identification mark being sensed;

sensing a second position identification mark spaced apart from the first position identification mark in a rotation direction of the intermediate transfer belt; and forming the developer image on the photoconductor and transferring the formed developer image to the intermediate transfer belt in response to the second position identification mark being sensed, wherein a sensing time of the second position identification mark is a time when the cleaning unit is spaced apart from the intermediate transfer belt, wherein the sensing the second position identification mark includes sensing a predetermined number of the second position identification marks, such that the sensed first position identification mark is ignored so that the predetermined number of the second position identification marks can be sensed.

16. The control method according to claim 15, wherein the cleaning unit, arranged to come into contact with the intermediate transfer belt and to remove the developer residue, is moved away from the intermediate transfer belt when the first position identification mark, which is arranged forward of the second position identification mark in the rotation direction of the intermediate transfer belt, is sensed.

17. The control method according to claim 16, wherein the cleaning unit is moved away from the intermediate transfer belt only when the first position identification mark is initially sensed.

18. The control method according to claim 15, wherein a plurality of developer images overlap one another on the intermediate transfer belt.

19. The control method according to claim 18, wherein the plurality of developer images include at least two developer images having different colors.

20. The control method according to claim 18, further comprising:

transferring the plurality of developer images formed on the intermediate transfer belt to a surface of a printing medium to form a secondary transfer image.

21. The control method according to claim 20, further comprising:

fusing the secondary transfer image to the printing medium with a fusing apparatus of the image forming apparatus.

22. A method of controlling an image forming apparatus, the method comprising:

moving a cleaning unit away from an intermediate transfer belt of the image forming apparatus in response to a first position identification mark disposed on the intermediate transfer belt being detected by a position sensing unit;

detecting a second position identification mark spaced apart from the first position identification mark in a rotation direction of the intermediate transfer belt; and transferring a developer image from a photoconductor of the image forming apparatus to the intermediate transfer belt in response to the second position identification mark being detected, wherein a sensing time of the second position identification mark is a time when the cleaning unit is spaced apart from the intermediate transfer belt, wherein the detecting the second position identification mark includes detecting a predetermined number of the second position identification marks, such that the detected first position identification mark is ignored so that the predetermined number of the second position identification marks can be detected.

23. The method of claim 22, further comprising:

transferring the developer image formed on the intermediate transfer belt to a surface of a printing medium to form a secondary transfer image.

24. The method of claim 22, further comprising:

detecting the second position identification mark when the intermediate transfer belt has rotated;

forming a second developer image having a second color;

transferring the second developer image from a photoconductor of the image forming apparatus to the intermediate transfer belt when the second position identification mark is detected; and transferring the second developer image formed on the intermediate transfer belt to a surface of a printing medium to form a secondary transfer image.

25. An image forming apparatus, comprising:

a photoconductor;

a transfer member to receive a developer image formed on the photoconductor, the transfer member including a first position identification mark and a second position identification mark arranged in a rotation direction of the transfer member;

a moveable cleaning unit moveable between a contact position with the transfer member and to remove residue therefrom and a separation position therefrom;

a position sensing unit to sense a position of the first and second position identification marks; and a control unit to move the cleaning unit between the position in contact with the transfer member and the separation position in response to a sensed position of the first position identification mark, and when the cleaning unit is spaced apart from the transfer member, the control unit senses the second position identification mark and controls the formation of a plurality of developer images on the transfer member, wherein a sensing time of the second position identification mark is a time when the cleaning unit is spaced apart from the intermediate transfer belt, wherein the position sensing unit senses a predetermined number of the second position identification marks, such that the sensed first position identification mark is ignored so that the position sensing unit can sense the predetermined number of the second position identification marks.

26. The image forming apparatus of claim 25, wherein the control unit forms the plurality of developer images that overlap one another on the transfer member.

27. The image forming apparatus of claim 26, wherein the control unit controls the plurality of developer images formed on the transfer member to be transferred to a surface of a printing medium.

* * * * *